United States Patent [19]

Eppes

[11] Patent Number: 4,764,021

[45] Date of Patent: Aug. 16, 1988

[54] APPARATUS FOR ULTRASONIC AGITATION OF LIQUIDS

[75] Inventor: William R. Eppes, Mansfield, Mass.

[73] Assignee: Corning Glass Works, Corning, N.Y.

[21] Appl. No.: 468,164

[22] Filed: Feb. 22, 1983

[51] Int. Cl.[4] ..... B01F 11/02

[52] U.S. Cl. ..... 366/127; 366/116; 310/328

[58] Field of Search ..... 366/108, 114, 116, 117, 366/118, 120, 127, 176; 310/328

[56] References Cited

U.S. PATENT DOCUMENTS

| | | | |
|---|---|---|---|
| 2,138,839 | 12/1938 | Chambers . | |
| 2,219,348 | 10/1940 | Turner, Jr. . | |
| 2,498,737 | 2/1950 | Holden . | |
| 3,328,610 | 6/1967 | Jacke et al. | 366/108 |
| 3,715,104 | 2/1973 | Cottell | 366/118 |
| 3,825,481 | 7/1974 | Supitilov . | |
| 3,972,614 | 8/1976 | Johansen et al. | 366/116 |
| 3,984,086 | 10/1976 | Gerrish | 366/127 |
| 4,118,797 | 10/1978 | Tarpley, Jr. | 366/127 |
| 4,134,678 | 1/1976 | Brown et al. | 356/39 |

*Primary Examiner*—Harvey C. Hornsby
*Assistant Examiner*—Frankie L. Stinson
*Attorney, Agent, or Firm*—William J. Simmons, Jr.

[57] ABSTRACT

Disclosed is a fluid flow sonic energy reactor particularly adapted for blood hemolysis. An ultrasonic generator is provided with a tapered resonator, the small diameter end of which forms one planar surface of the reactor cavity. The reactor includes an anvil, one end of which has a central surface region that is closely spaced from the small diameter end of the tapered resonator. An O-ring is in contact with the periphery of the small diameter end of the resonator as well as the adjacent surface of the anvil to form therebetween a sealed chamber. First and second bores extend through the anvil to the central surface region thereof to introduce fluid into the chamber and remove fluid therefrom.

10 Claims, 2 Drawing Sheets

APPARATUS FOR ULTRASONIC AGITATION OF LIQUIDS

BACKGROUND OF THE INVENTION

The present invention relates to a fluid flow sonic energy reactor and more particularly to a reactor comprising a chamber through which a flow of fluid is subjected to ultrasonic energy.

The treatment of various liquids by ultrasonic energy is well known. For example, U.S. Pat. Nos. 3,972,614 and 4,134,678 disclose automatic blood analysis apparatus wherein thin samples of blood are spectrophotometrically analyzed to determine such parameters as total hemoglobin, percent oxyhemoglobin, percent carboxyhemoglobin and the like. To accurately determine these parameters the blood must first be hemolyzed. U.S. Pat. No. 4,134,678 teaches a mechanical hemolyzer which employs a solenoid. U.S. Pat. No. 3,972,614 teaches an instrument wherein the blood is hemolyzed and analyzed in the same tubular chamber. The speed of operation of both of these prior art instruments is limited by the time required to hemolyze the blood.

It is well known that horn resinators can be employed to concentrate ultrasonic energy. U.S. Pat. Nos. 3,715,104 and 3,825,481 employ horn resonators to couple ultrasonic energy to the treated fluid which may comprise foods, medicaments, cosmetics and the like. Both of these patents teach sonic energy reactors in which the entire tapered horn resinator projects into a chamber through which flows the fluid being treated. While such sonic energy reactors are suitable for treating large quantities of fluids, they are not suitable for treating small samples such as those encountered in blood analysis apparatus since the blood samples are small. Also, these reactors are difficult to clean with the result that adjacent samples can become cross-contaminated.

SUMMARY OF THE INVENTION

An object of the present invention is to provide a fluid flow sonic energy reactor which is capable of reacting fluids flowing therethrough at high rates. Another object is to provide such a reactor which is easily cleaned by flowing a wash solution therethrough. A more specific object is to provide a device for anaerobically hemolyzing blood at flow rates compatible with the demands of automated blood analyzing instruments. Another object is to provide a sonic blood hemolyzer which prevents cross-contamination between samples.

Briefly, the present invention pertains to a fluid flow sonic energy reactor comprising a sonic energy generator which includes a tapered resonator. The resonator has a first surface in contact with the sonic energy generator and a second, longitudinally opposed surface of smaller area than the first surface. An anvil located adjacent to the second surface of the resonator has a surface that is situated in close proximity to the second surface. Resilient means in contact with the periphery of the second surface of the resonator, and the adjacent surface of the anvil forms between those two surfaces a sealed chamber. Means are provided for introducing and removing fluid from the chamber.

DESCRIPTION OF THE PREFERRED EMBODIMENT

Figure 1:
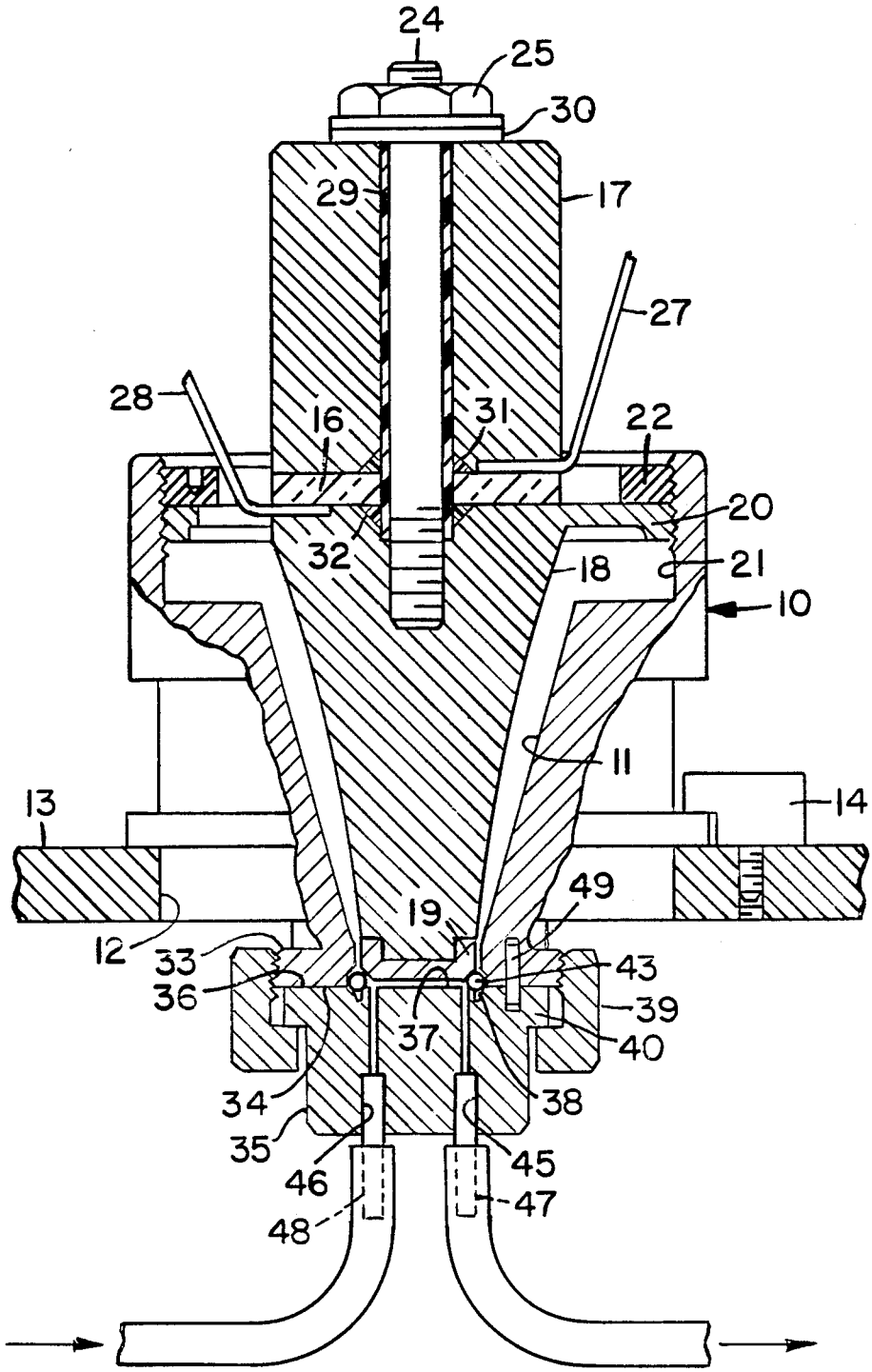
FIG. 1 is a side elevational view in partial cross-section of the hemolizer of the present invention.
Figure 2:
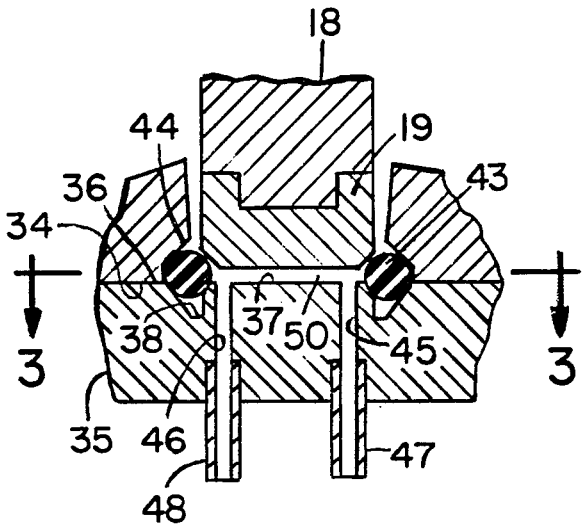
FIG. 2 is a detailed cross-sectional view of the hemolizing chamber.
Figure 3:
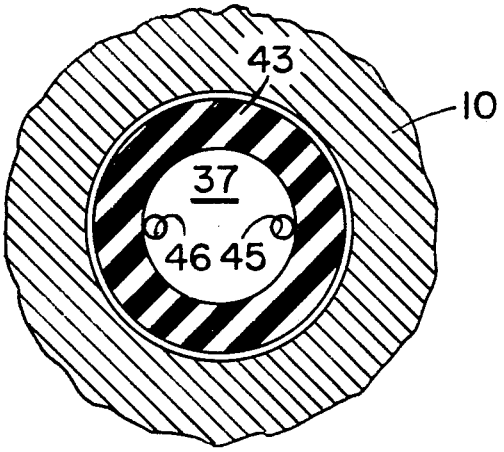
FIG. 3 is a cross-sectional view taken along lines 3—3 of FIG. 2.

Whereas the present invention generally pertains to ultrasonic energy reactors for processing fluids, the apparatus of FIG. 1 was specifically designed for the continuous hemolysis of blood samples for automated blood analysis instruments. A housing 10 having a conically shaped cavity 11 therein is mounted in an opening 12 in wall 13 of the instrument. Housing 10 is secured to wall 13 by a plurality of hold-down clamps 14 which engage a flange on the housing. The housing functions as a stabilizing mass that provides vibrational damping.

A piezoelectric crystal 16 is sandwiched laterally between a base resonator 17 and a horn resonator 18. The crystal may be formed of a lead titanate lead zirconate composition. A coating of conductive materials such as silver is fired to both sides of the crystal. To insure close communication between the crystal and the resonators, an adhesive support medium is layered on either side of the crystal. The adhesive system preferably consists of a metallic mesh coated with an epoxy bonding material.

Elements 16, 17 and 18 form a conventional half-wave ultrasonic resonators in which the piezoelectric crystal is located at the velocity node, velocity anti nodes being located at either outer end of the assembly. Resonators 17 and 18 may be formed of glass, aluminum, stainless steel, or the like. It is well known that by reducing the cross-sectional area of a resonator from the crystal towards its tip, a magnification of displacement will occur. Whereas resonator 18 of the present invention was provided with an exponential shape, other shapes such as stepped, conical, and the like may be employed. Since tapered resonator 18 was formed of aluminum, the small diameter tip thereof was provided with a stainless steel cap 19 to provide a suitable blood-contacting surface. Cap 19 may be connected to resonator 18 by suitable means such as epoxy bonding, threading, and the like. Resonator 18 is provided with a flanged end 20, the outer edge of which is threaded so that it may be screwed into the threaded bore 21 of housing 10. After resonator 18 has been advanced the proper distance into cavity 11, the resonator is secured in its proper position by ring nut 22.

Because the crystal is located at a velocity node, the compressive and tensile stresses are maximum. If the crystal were not prestressed, prolonged operation could result in deterioration of hemolyzing capacity, brought about by failure of the bond joint or the crystal itself. A well known method of avoiding fracturing or deterioration of the crystal during operation is to preload the system by means of through bolt 24, which is threaded into an axial bore in resonator 18. The crystal is preferably preloaded with a force up to 30 in. lbs. Bolt 24 and nut 25 may be formed of high tensile steel.

Electrical connection was made to the crystal by placing a flat conductor 27 in contact with the conductive coating on that side of the crystal adjacent to resonator 17. Similarly, the opposite side of crystal 16 was connected to ground potential through flat conductor 28. To prevent bolt 24 from shorting the crystal, insulating sleeve 29 surrounds bolt 24 in the region of crystal 16 and resonator 17. Also, an insulating washer 30 is located adjacent resonator 17 on bolt 24. The surfaces of resonator 17 and 18 adjacent to crystal 16 in the vicinity of the bore through which bolt 24 passes are bevelled to provide cavities 31 and 32 into which epoxy flows during the fabrication of the crystal and resonator assembly.

The crystal is powered by a circuit which generates a peak-to-peak potential between 800 and 1000 volts. The frequency of the driving potential is generally between 20 and 100 kilocycles per second for ultrasonic generators, a frequency around 37 kilocycles per second being preferred for use in blood hemolyzers.

A threaded cylindrical protrusion 33 of housing 10 extends through wall 13. Protrusion 33 has an annular end surface 34 having an opening in which cap 19 is centered. Longitudinally adjacent to protrusion 33 is an anvil 35. The end of the anvil adjacent to protrusion 33 has a peripheral surface region 36 and a central surface region 37 separated by an annular groove 38. Retaining nut 39 engages flange 40 of anvil 35 so that surfaces 34 and 36 can be brought into contact by tightening nut 39. An O-ring 43 or a similar gasket of elastomeric material, which is situated in groove 38, is compressed against the bevelled edge of cap 19 when surfaces 34 and 36 are brought into contact. The opening in housing protrusion 33 is also provided with an annular groove 44 to accommodate O-ring 43. The O-ring may be formed of a material such as Viton, silicone, rubber or the like which is resistant to alcohol, dilute acids, concentrated acids, concentrated alkalies and blood. The dimensions of grooves 38 and 44 and the extent of bevelling of cap 19 must be coordinated such that the O-ring is properly compressed whereby it seals the periphery of chamber 50 formed between anvil surface 37 and the end surface of cap 19. Too much compression of the O-ring will result in difficulty in seating the anvil and deflection of the exponential horn assembly, thus resulting in improper clearance between the tip of cap 19 and surface 37. Even though the O-ring is continually subjected to compression and relaxation during operation, it is capable of providing many hours of operating life.

Bores 45 and 46 extend through anvil 35 and emerge at diametrically opposed locations on surface 37. The ends of the bores opposite surface 37 may be enlarged to receive stainless steel piping 47 and 48. An alignment pin 49, which protrudes from surface 34, must be seated in a bore in anvil 35 to properly orient bores 45 and 46.

Surface 37 of anvil 35 may or may not be coplanar with surface 36 thereof. In a preferred embodiment these surfaces were not coplanar, surface 37 extending closer to cap 19 than surface 36. In assemblying the hemolyzer of FIG. 1 it is necessary to adjust the position of resonator 18 with respect to housing 10 so that the end surface of tip 19 is properly located. When anvil 35 is secured to housing protrusion 33, the spacing between surface 37 and the end surface of cap 19 is preferably between about 0.004 and 0.006 in.

Blood enters hemolyzing chamber 50 through input tube 48 and exits through output tube 47. The anvil is preferably oriented such that output tube 47 is located at the top of the chamber so that no bubbles can be entrapped in the chamber. The chamber thus formed functions in such a manner that all of the blood that enters is subjected to compression and relaxation at ultrasonic frequencies. The resulting cavitation induces complete hemolysis due to the effective communication of ultrasonic energy between the crystal and the blood sample. In the instrument in which the above-described hemolyzer is employed, the blood sample flows from output tube 47 to a measurement chamber where it is spectrophotometrically analyzed. After the measurement is made, the sample is evacuated to a waste receptacle and further cleansing of the lines is commenced by reactivating the hemolyzer and engaging a pump which draws a cleaning solution through the lines. A final drying period is initiated by actuation of a vacuum pump and concluded by the release of any built-up vacuum through a vent. Since the cavity in which hemolysis occurs is bounded by only the tip of the resonator cap, and since the input and output lines are connected to diametrically opposed portions of the cavity, the cavity is quickly cleansed of any trace of the sample so that a number of samples can be quickly analyzed in succession without cross-contamination. The hemolyzer of the present invention has achieved 99.5% hemolysis of blood flowing therethrough at rates between 5 μl/sec. and 30 μl/sec. For this test the gap between surface 37 and cap 19 was 0.005 in. and the diameter of the end surface of cap 19 was 0.37". The ultrasonic generator was powered by 800 volts peak-to-peak, and the power required was greater than 10 watts.

Anvil 35 is readily removed to permit routine chamber inspection, clearing or replacement of parts.

I claim:

1. A fluid flow sonic energy reactor comprising a sonic energy generator, a tapered resonator having a first surface in contact with said generator and a longitudinally opposed second surface of smaller area than said first surface, an anvil having a surface that is closely spaced from said second surface, elastomeric means in contact with both the periphery of said second surface and the adjacent surface of said anvil, the space between said second surface and said anvil and within said elastomeric means defining a sealed chamber, means for introducing fluid into said chamber, means for removing fluid from said chamber, and means for supporting said resonator.

2. A reactor in accordance with claim 1 wherein said anvil is provided with an end which includes a central surface region, a peripheral surface region surrounding said central surface region, and an annular groove separating said surface regions, said elastomeric means being situated in said groove, said central surface region constituting said anvil surface which is closely spaced from said second surface.

3. A reactor in accordance with claim 2 wherein said elastomeric means is an O-ring.

4. A reactor in accordance with claim 3 wherein said resonator includes a cap affixed to the small diameter end thereof, said cap forming said second surface, said cap being formed of a material that is resistant to attack by said fluid.

5. A reactor in accordance with claim 4 wherein the end of said cap which forms said second surface of said resonator is beveled in the region where it contacts said O-ring.

6. A reactor in accordance with claim 5 wherein said support means comprises a housing having sufficient mass to provide vibrational damping for said generator, said housing having a tapered cavity and an annular threaded region adjacent to the larger end of said cavity, a threaded flange projecting radially from the large diameter end of said tapered resonator, said threaded flange engaging said annular threaded region of said housing, said tapered resonator extending into the tapered cavity of said housing, said resonator being spaced from the wall of said cavity, said housing having an end surface perpendicular to the axis of said cavity in the vicinity of said cap, said housing end surface having an annular opening in which the end of said cap is located, said housing end surface contacting the peripheral surface region of said anvil.

7. A reactor in accordance with claim 6 wherein said housing end surface has an annular groove at the periphery of the opening therein, said O-ring being seated in the groove in said housing end surface.

8. A reactor in accordance with claim 7 wherein said means for introducing and removing fluid from said chamber comprises first and second bores, respectively, which extend through said anvil and terminate at diametrically opposed points on said central surface region, the intersection of said first and second bores with said central surface region being adjacent to the point of contact of said O-ring and said central surface region.

9. A reactor in accordance with claim 8 wherein said anvil is circular in cross-section and includes a flange in the vicinity of said peripheral surface region, said reactor further comprising means for engaging said flange and securing said anvil to said housing.

10. A reactor in accordance with claim 9 further comprising means for aligning said anvil with said housing so that said means for removing fluid from said chamber is oriented vertically upwardly.

* * * * *